US007566184B2

(12) United States Patent
Befve et al.

(10) Patent No.: US 7,566,184 B2
(45) Date of Patent: Jul. 28, 2009

(54) PACKAGING AND APPLICATOR DEVICE

(75) Inventors: Denis Befve, Arras (FR); Gilles Baudin, Domont (FR)

(73) Assignee: L'Oreal, Paris (FR)

( * ) Notice: Subject to any disclaimer, the term of this patent is extended or adjusted under 35 U.S.C. 154(b) by 235 days.

(21) Appl. No.: 11/723,305

(22) Filed: Mar. 19, 2007

(65) Prior Publication Data

US 2008/0066774 A1 Mar. 20, 2008

Related U.S. Application Data

(60) Provisional application No. 60/792,632, filed on Apr. 18, 2006.

(30) Foreign Application Priority Data

Mar. 17, 2006 (FR) ..... 06 50934

(51) Int. Cl.
*A46B 11/00* (2006.01)

(52) U.S. Cl. ..... 401/129; 401/126

(58) Field of Classification Search ..... 401/122, 401/126–130

See application file for complete search history.

(56) References Cited

U.S. PATENT DOCUMENTS 705,271 A * 7/1902 Miner ..... 401/130
2,348,515 A * 5/1944 Baumgartner ..... 15/195
3,662,769 A 5/1972 Vasas et al.
4,527,575 A * 7/1985 Vasas ..... 132/218
4,784,505 A 11/1988 Dahm
6,343,887 B1 2/2002 Dumler et al.
2004/0096261 A1 5/2004 Gueret
2007/0025803 A1 2/2007 Dieudonat

FOREIGN PATENT DOCUMENTS

FR 2 874 160 A1 2/2006

* cited by examiner

*Primary Examiner*—David J Walczak
(74) *Attorney, Agent, or Firm*—Oliff & Berridge, PLC

(57) ABSTRACT

A packaging and applicator device includes a receptacle containing a composition for application, a wiper member, and an applicator. The applicator includes a stem, an applicator element at a distal end of the stem, and a handle at a proximal end of the stem. The stem has a first segment that is secured to the handle and has a portion that is level with the wiper member when the receptacle is closed by the applicator. A second segment has two ends, is fastened to the first segment, carries the applicator element, and is configured so as to enable the second segment to be assembled via either of the ends on the first segment.

18 Claims, 1 Drawing Sheet

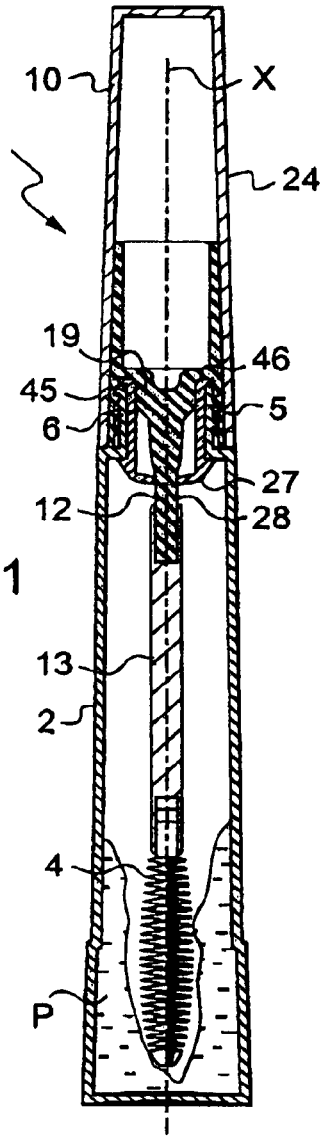
Fig.1
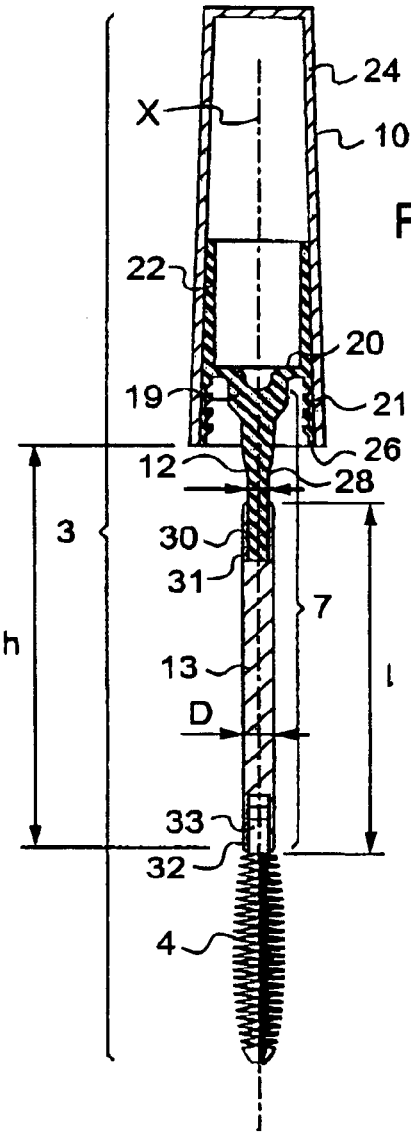
Fig.2
Fig.3
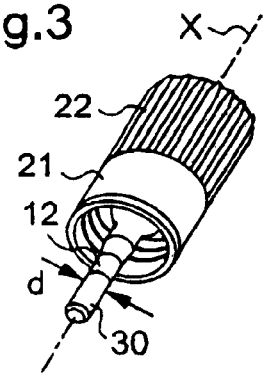
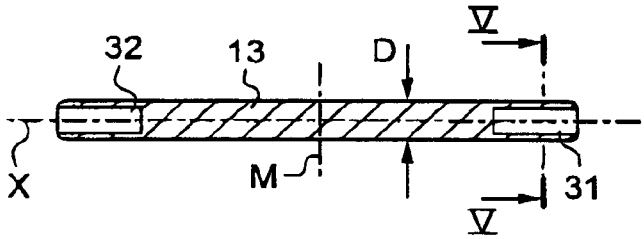
Fig.4
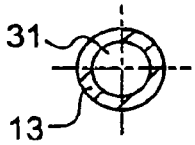
Fig.5

PACKAGING AND APPLICATOR DEVICE

This non provisional application claims the benefit of French Application No. 06 50934 filed on Mar. 17, 2006 and U.S. Provisional Application No. 60/792,632 filed on Apr. 18, 2006.

The present invention relates to packaging and applicator devices for applying a cosmetic or a skin care product.

BACKGROUND OF THE INVENTION

Numerous devices are known including an applicator comprising a stem and an applicator element at one end of the stem. The composition for application is taken from a receptacle having a neck that is provided with a wiper member of diameter that is adapted to the diameter of the stem.

It can be advantageous to make the wiper member with a section that is relatively small, so that wiping is more thorough.

In order to avoid the wiper member being unduly stressed when the receptacle is closed by the applicator, it is known to make the stem with an annular constriction at its portion that comes to be positioned in contact with the wiper member.

However, making such a constriction complicates the manufacture of the stem, since it is necessary to use a slide mold.

U.S. Pat. No. 6,343,887 discloses an applicator comprising a stem that is formed of two assembled-together segments: a first segment that is secured to the handle; and a second segment that has a non-symmetrical shape and that carries the applicator element.

OBJECT AND SUMMARY OF THE INVENTION

The invention seeks to remedy the drawback associated with using a slide mold, while simplifying assembly compared with the applicator disclosed in U.S. Pat. No. 6,343,887.

The invention achieves this by means of a packaging and applicator device comprising:

- a receptacle containing a composition for application;
- a wiper member; and
- an applicator comprising:
  - a stem;
  - an applicator element at a distal end of the stem; and
  - a handle at a proximal end of the stem;

in which device the stem comprises:

- a first segment that is secured to the handle and that has a portion that comes to be positioned level with the wiper member when the receptacle is closed by the applicator; and
- a second segment that is fastened to the first segment and that carries the applicator element, the second segment having preferably a shape that is generally symmetrical about a mid-plane that is perpendicular to its longitudinal axis, and being configured so as to enable it to be assembled via either of its ends with the first segment.

At least one point along its length, the second segment may present a cross-section that is greater than a cross-section of the above-mentioned portion of the first segment.

By means of the invention, the stem may be manufactured without using a slide mold.

In addition, the symmetrical shape of the second segment makes it easier to assemble with the applicator element and with the first segment, avoiding any need to distinguish between the two ends of the segment.

The second segment may include a housing at its distal end for fastening the applicator element.

The second segment may extend longitudinally over a length that occupies more than half the visible length of the stem, for example.

The first segment may be integrally molded with a cap-liner.

The cap-liner may include an internally-threaded mounting skirt that is arranged to be fastened on a threaded neck of the receptacle.

The cap-liner may also be made with a tubular top portion that serves to hold the cap-liner in a cap defining a grip surface.

The first and second segments may be arranged in such a manner as to be assembled in non-removable manner, e.g. by clamping, the first segment including an end portion that is force fitted in a housing of the second segment, for example. In a variant, assembly may be performed by screw-fastening or by snap-fastening, for example.

The wiper member may include a flexible lip.

The flexible lip may be secured to a fastener portion that is engaged in the neck of the receptacle, e.g. being snap-fastened therein. The fastener portion may include an annular rim that bears against the top end of the neck of the receptacle, so as to participate in closing the receptacle in sealed manner, for example.

The wiper member may be made of a flexible material having little shape memory, e.g. of nitrile that is easily deformable.

The applicator element may be a brush, for example.

The receptacle may contain mascara, for example.

BRIEF DESCRIPTION OF THE DRAWING

The invention can be better understood on reading the following detailed description of a non-limiting embodiment thereof, and on examining the accompanying drawing, in which:

- FIG. 1 is a diagrammatic longitudinal section of a device constituting an embodiment of the invention;
- FIG. 2 shows the applicator of the FIG. 1 device in isolation;
- FIG. 3 shows the cap-liner together with the first stem segment in isolation;
- FIG. 4 is a longitudinal section showing the second stem segment in isolation; and
- FIG. 5 is a cross-section on V-V of FIG. 4.

MORE DETAILED DESCRIPTION

The packaging and applicator device 1 shown in FIG. 1 comprises: a receptacle 2 containing a composition P, e.g. mascara; and an applicator 3 of longitudinal axis X, shown in isolation in FIG. 2, and including an applicator element 4 for taking the composition P.

The top portion of the receptacle 2 presents a neck 5 that is provided with a wiper member 6. The wiper member includes a fastener portion 45 that is snap-fastened in the neck, and that can be provided with an annular rim 46 that bears against the top end of the neck.

The applicator 3 includes a stem 7 that is connected at its proximal end to a handle 10 and at its distal end to the applicator element 4.

The stem 7 is made up of a first segment 12 and of a second segment 13 that is made separately from the first segment and that is fastened thereto.

The first segment 12 is connected via a wide portion 19 to a cap-liner that includes a transverse wall 20. At its periphery, the transverse wall is extended downwards by an internally-threaded mounting skirt 21 that is arranged to be screw-fastened on the neck 5 of the receptacle 2, and it is extended upwards by a tubular skirt 22 that is longitudinally fluted and that is used for mounting a cap 24 on the cap-liner. The cap extends to the bottom end 26 of the mounting skirt 21, and extends upwards beyond the skirt 22, in such a manner as to offer the user a sufficient grip surface.

The first segment 12 includes a portion 28 that comes to be positioned level with a wiper lip 27 of the wiper member 6 when the receptacle is closed by the applicator, as shown in FIG. 1.

In the embodiment shown, the portion 28 of the first segment presents a solid, circular cross-section, and its outside diameter is substantially equal to the inside diameter of the wiper lip 27.

Thus, the stem can contact the wiper lip 27, but without stressing it unduly, or indeed without touching it at all, where appropriate.

Below the portion 28, the first segment 12 includes a distal portion 30 that is engaged in a housing 31 of the second segment 13. The second segment presents a shape that is generally circularly symmetrical about the axis X, and a shape that is generally symmetrical about a mid-plane of symmetry M that is perpendicular to the axis X, as can be seen in FIG. 4.

By way of example, the applicator element 4 is a brush having an endpiece 33 that is force fitted in a housing 32 of the segment 13, said housing 32 being remote from the housing 31.

The endpiece 33 can have the same shape as the distal portion 30.

In the embodiment under consideration, the second segment extends over a length l that occupies more than half the visible length h of the stem, as can be seen in FIG. 2.

The ratio D/d of the diameter D of the second segment 13 to the diameter d of the portion 28 of the first segment 12 lies in the range 1.1 to 5, for example, better in the range 1.2 to 1.8, e.g. close to 1.45.

Naturally, the invention is not limited to the embodiment described above.

In particular, the applicator element could be other than a brush, e.g. a comb for applying a composition to keratinous fibers, in particular the eyelashes or the eyebrows, or an endpiece, e.g. a flocked endpiece, for applying a composition to the lips or to the skin, in particular to the eyelids.

The applicator element could also comprise a felt or a bundle of bristles formed by stapling a tuft of bristles in the end housing 32 of the second segment, for example.

The housings 31 and 32 of the second segment could be of circular shape, as shown in FIG. 5, or they could be of other shapes, e.g. so as to make it easier to assemble the second segment with the applicator element and/or with the first segment. The second segment could also be made without the housings 31 and 32, said housings being replaced by male assembly elements, for example.

The stem could comprise more than two segments, where appropriate.

The second segment could be fastened to the first segment in removable manner, e.g. so as to enable the user to change applicator element by selecting another unit made up of a second segment and of an applicator element.

In the embodiment under consideration, the second segment extends along a rectilinear longitudinal axis, but, in a variant, it could extend along a curvilinear longitudinal axis.

The second segment could be made of a rigid thermoplastic material, or, in a variant, of an elastically-deformable thermoplastic material, e.g. an elastomer.

The wiper member could be made in some other way, e.g. with an annular lip presenting a different shape and/or one or more slots.

Where appropriate, the device could include means that are adjusted by the user, so as to vary the diameter of the wiper member and vary the amount of wiping.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The expression "comprising a" should be understood as being synonymous with "comprising at least one", unless specified to the contrary.

What is claimed is:

1. A packaging and applicator device comprising:

a receptacle containing a composition for application;

a wiper member; and an applicator comprising:

a stem;

an applicator element at a distal end of the stem; and a handle at a proximal end of the stem;

in which device the stem comprises:

a first segment that is secured to the handle and that has a portion that comes to be positioned level with the wiper member when the receptacle is closed by the applicator; and a second segment comprising two ends, that is fastened to the first segment, that carries the applicator element, and that is configured so as to enable said second segment to be assembled via either of said ends on the first segment.

2. A device according to claim 1, wherein the second segment presents a shape that is generally symmetrical about a mid-plane that is perpendicular to the longitudinal axis of the second segment.

3. A device according to claim 1, in which the second segment presents a shape that is circularly symmetrical.

4. A device according to claim 1, the second segment having, at at least one point along its length, a cross-section that is greater than a cross-section of the portion of the first segment.

5. A device according to claim 1, in which the second segment includes a housing at its distal end for fastening the applicator element.

6. A device according to claim 1, in which the stem has a visible length and in which the second segment extends longitudinally over a length that occupies more than half the visible length of the stem.

7. A device according to claim 1, in which the first segment is integrally molded with a cap-liner.

8. A device according to claim 7, in which the cap-liner includes an internally-threaded mounting skirt that is arranged to be fastened on a threaded neck of the receptacle.

9. A device according to claim 7, in which the cap-liner is made with a tubular top portion that serves to hold the cap-liner in a cap defining a grip surface.

10. A device according to claim 1, in which the first and second segments are arranged in such a manner as to be assembled in non-removable manner.

11. A device according to claim 1, in which the wiper member includes a flexible lip.

12. A device according to claim 11, in which the flexible lip is secured to a fastener portion that is engaged in a neck of the receptacle.

13. A device according to claim 12, in which the fastener portion includes an annular rim that bears against a top end of the neck of the receptacle.

14. A device according to claim 1, in which the applicator element is a brush.

15. A device according to claim 1, in which the receptacle contains mascara.

16. A device according to claim 1, the second segment presenting an outside diameter D, and the portion of the first segment presenting an outside diameter d, a ratio D/d lying in the range 1 to 5.

17. A device according to claim 16, the ratio D/d being in the range 1.2 to 1.8.

18. A device according to claim 1, the first segment having a distal portion that has the same shape as an endpiece of the applicator element engaged in a housing of the second segment.

* * * * *